US009314702B2

(12) United States Patent
Stafford

(10) Patent No.: US 9,314,702 B2
(45) Date of Patent: Apr. 19, 2016

(54) APPARATUS AND METHOD PERTAINING TO NON-MESH, HAIR-SECUREMENT ELONGATED STRIPS FOR USE WITH A DOLL

(71) Applicant: Margaret Mary Stafford, Palatine, IL (US)

(72) Inventor: Margaret Mary Stafford, Palatine, IL (US)

( * ) Notice: Subject to any disclaimer, the term of this patent is extended or adjusted under 35 U.S.C. 154(b) by 82 days.

(21) Appl. No.: 14/182,842

(22) Filed: Feb. 18, 2014

(65) Prior Publication Data

US 2015/0231517 A1 Aug. 20, 2015

(51) Int. Cl.
*A63H 3/02* (2006.01)
*A63H 3/44* (2006.01)

(52) U.S. Cl.
CPC ..... *A63H 3/44* (2013.01)

(58) Field of Classification Search
USPC ..... 446/296, 319, 372, 394; 434/100, 377, 434/395
See application file for complete search history.

(56) References Cited

U.S. PATENT DOCUMENTS

| | | | | | |
|---|---|---|---|---|---|
| 1,133,196 | A * | 3/1915 | Teugler | 132/53 |
| 1,490,479 | A * | 4/1924 | Noel | 132/53 |
| 2,152,085 | A * | 3/1939 | Palmer | 446/394 |
| 2,343,141 | A * | 2/1944 | Ford | 446/394 |
| 2,651,310 | A * | 9/1953 | Selson | 132/274 |
| 3,500,578 | A * | 3/1970 | Irving | 446/394 |
| 3,672,376 | A * | 6/1972 | Parlagreco | 132/212 |
| 3,692,031 | A * | 9/1972 | Fields | 132/212 |
| 3,765,123 | A * | 10/1973 | Terzian | 446/394 |
| 4,037,274 | A * | 7/1977 | Agosta | 623/15.11 |
| 4,370,137 | A * | 1/1983 | Herzig et al. | 434/94 |
| 4,403,962 | A * | 9/1983 | La Vista | 434/94 |
| 4,674,169 | A * | 6/1987 | Katzman et al. | 29/432 |
| 4,874,345 | A * | 10/1989 | Dirks | 446/394 |
| 5,299,968 | A * | 4/1994 | Bennett | 446/394 |
| 5,586,696 | A * | 12/1996 | Martinez | 223/66 |
| 5,647,384 | A * | 7/1997 | Haber et al. | 132/105 |
| 5,979,462 | A * | 11/1999 | Jones | 132/54 |
| 6,090,142 | A * | 7/2000 | Grifka et al. | 623/15.11 |
| 6,527,618 | B1 * | 3/2003 | Faunda et al. | 446/394 |
| 7,222,627 | B1 * | 5/2007 | Johns | 132/54 |
| 7,735,495 | B2 * | 6/2010 | Lane et al. | 132/53 |
| 7,862,613 | B1 * | 1/2011 | Costabile | 623/15.11 |
| 8,262,392 | B2 * | 9/2012 | Kubo | 434/94 |
| 8,506,345 | B2 * | 8/2013 | Tigan et al. | 446/369 |
| 8,753,367 | B1 * | 6/2014 | Costabile | 606/187 |
| 2004/0237985 | A1 * | 12/2004 | Ball | 132/54 |
| 2006/0141900 | A1 * | 6/2006 | Wesley | 446/394 |
| 2009/0056730 | A1 * | 3/2009 | Wilson et al. | 132/53 |
| 2010/0037908 | A1 * | 2/2010 | Hatcher et al. | 132/201 |

* cited by examiner

*Primary Examiner* — Kurt Fernstrom
(74) *Attorney, Agent, or Firm* — Steven G. Parmelee

(57) ABSTRACT

A doll body (such as but not limited to a doll head) having an exterior surface (such as a scalp) and at least one non-mesh hair securement strip disposed on the exterior surface. By one approach at least two minor portions of the aforementioned non-mesh hair securement strip are constrained with respect to movement away from the exterior surface of the doll body such that at least one majority portion of the strip can be moved away from the exterior surface with less constraint than the two minor portions. The majority portion moves away from the exterior surface of the doll body to facilitate disposing and securing hair components therein.

14 Claims, 15 Drawing Sheets

Doll with yarn.

Doll with ribbons and decorative picks.

Doll with macramé.

Doll with tulle and yarn.

Doll with bows.

Doll with bird nest.

APPARATUS AND METHOD PERTAINING TO NON-MESH, HAIR-SECUREMENT ELONGATED STRIPS FOR USE WITH A DOLL

TECHNICAL FIELD

This invention relates generally to dolls and more particularly to the attachment of hair to a doll.

BACKGROUND

Dolls and figurines have been collected and played with by persons of all ages for centuries. The earliest dolls were handmade using materials at hand such as wood or stone. Although some dolls are still handmade of materials such as cloth or ceramic, most dolls currently are mass produced and composed of plastic materials.

Traditional dolls usually have the normal body structure of humans or animals and sometimes fanciful creatures. For dolls bearing a human resemblance, those dolls often have a body containing arms and legs, a head with a face and all, some, or no facial features, and hair. Hair is conventionally attached permanently to the doll head, whether the doll is handmade or mass produced. This limits what the dolls can look like, in terms of hairstyles, materials used, and overall appearance.

In some cases the hair comprises a replaceable wig to thereby gain some flexibility with respect to hairstyle and so forth. The choices for replaceable wigs for dolls, however, is also restricted to only which replacement wigs, either brand or generic, are available that fit a particular doll's head size and shape.

With the dolls in use today, there is an overall restriction on what the doll's head covering can look like in that the head covering is generally immutable. Only the designers and manufacturers of the dolls can decide what each doll looks like and how much, if any, change can be made in terms of hair replacements. These restrictions place limitations on the doll owner's or user's creativity and ability to change or modify how a doll looks. This limitation is confined to what options are available for replacement hair, including wigs or the like.

BRIEF DESCRIPTION OF THE DRAWINGS

The above needs are at least partially met through provision of the apparatus and method pertaining to non-mesh, hair-securement elongated strips for use with a doll described in the following detailed description, particularly when studied in conjunction with the drawings, wherein.

Figure 1:
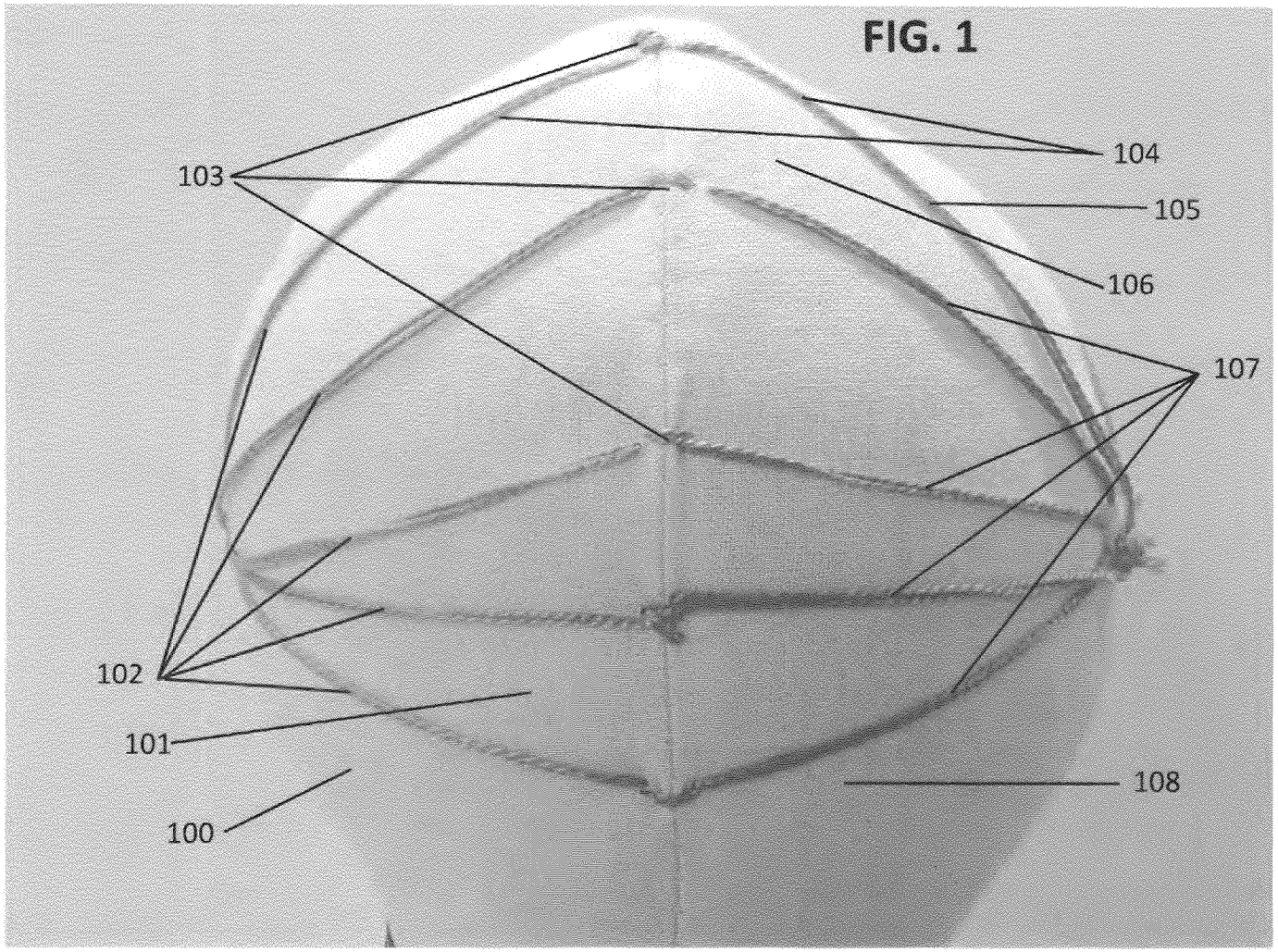
FIG. 1 comprises a rear view as configured in accordance with various embodiments of the invention.

Elements in the figures are illustrated for simplicity and clarity and have not necessarily been drawn to scale. For example, the dimensions and/or relative positioning of some of the elements in the figures may be exaggerated relative to other elements to help improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, these teachings present a doll body having an exterior surface and at least one non-mesh hair securement strip that rests on the exterior surface. The non-mesh hair securement strip has at least two minor portions that are constrained to small movements with respect to the exterior surface of the doll body. By one approach the non-mesh hair securement strip also contains a majority portion that can be moved away from the exterior surface with less constraint than the at least two minor portions.

By one approach the aforementioned "doll body" is primarily a doll head itself (which may include some or all of the physical features of an ordinary doll head, for example, a scalp, forehead, brow, crown, cheeks, chin, eyes, ears, nose, mouth, and/or the like). By one approach the non-mesh hair securements strips are placed at the brow and crown, and also interspersed on the back of the doll head between the crown portion and the just above the neck. Pursuant to one approach, each of these non-mesh hair securements strips have at least two minor portions and a majority portion.

By one approach these teachings will accommodate providing a doll head having a scalp area, where a plurality of loops are disposed in the scalp area to configure guide holes for the aforementioned majority portions of the non-mesh hair securement strips. These guide holes can be formed integrally into the doll head and are used to receive the non-mesh hair securement strips.

These teachings will also accommodate a doll body having an exterior surface (which may, or may not, include or comprise the scalp of the doll's head) and at least one non-mesh hair securement strip that rests or is otherwise disposed on that exterior surface. Again, the non-mesh hair securement strip can have at least two minor portions that are constrained to only small movements with respect to the exterior surface of the doll body while at least one majority portion of the non-mesh hair securement strip can be moved away from the exterior surface with less constraint than the at least two minor portions.

So configured, a hair component can be readily disposed between the surface of the doll head (or other exterior surface of choice) and the majority portion(s) of the non-mesh hair securement strip. These teachings are highly flexible in practice and will accommodate a great variety of both realistic and/or fanciful hair components. By way of example and without intending any limitations in these regards, a hair component can comprise, but is not limited to, real or artificial hair, yarn, tulle, fleece, felt, cloth, ribbons, pipe cleaners, macramé cord, holiday picks, artificial fruit and flowers, or anything similar to these components known in the art. When the hair component is secured to the majority portion of the non-mesh hair securement strip, the hair component can be secured by, but is not limited to, a tie, loop, weave, knot, drape, slip, tuck, pin, clip, adhesive, hooks-and-loops, or any other attachment mechanism known in the art.

So configured, these teachings readily allow and even encourage the user and/or manufacturer more flexibility as regards the appearance of each doll. By one approach, a manufacturer may offer the dolls with the non-mesh hair securement strips attached to the doll head and then create or otherwise acquire and offer different types of hair components that the user will attach to the doll's head using the provided non-mesh hair securement strips. By another approach, the manufacturer may offer dolls with an original full set of hair components already attached that the user may then freely and repeatedly change, if so desired. By yet another approach, the manufacturer may offer dolls with a removable wig covering the head and guide loops formed integrally into the doll head that may, or may not, be used at a later time to receive the non-mesh hair securement strips upon removing the wig.

The users now have essentially unlimited possibilities to imagine, design, and create what a given doll can look like. The number and variety of hair components is immense and will allow the user to change the hair components freely, repeatedly, and with ease. The utility of the apparatus and of these teachings provides both the opportunity and mechanism for essentially unrestrained creative expression by (either or both) the user or manufacturer.

Figure 2:
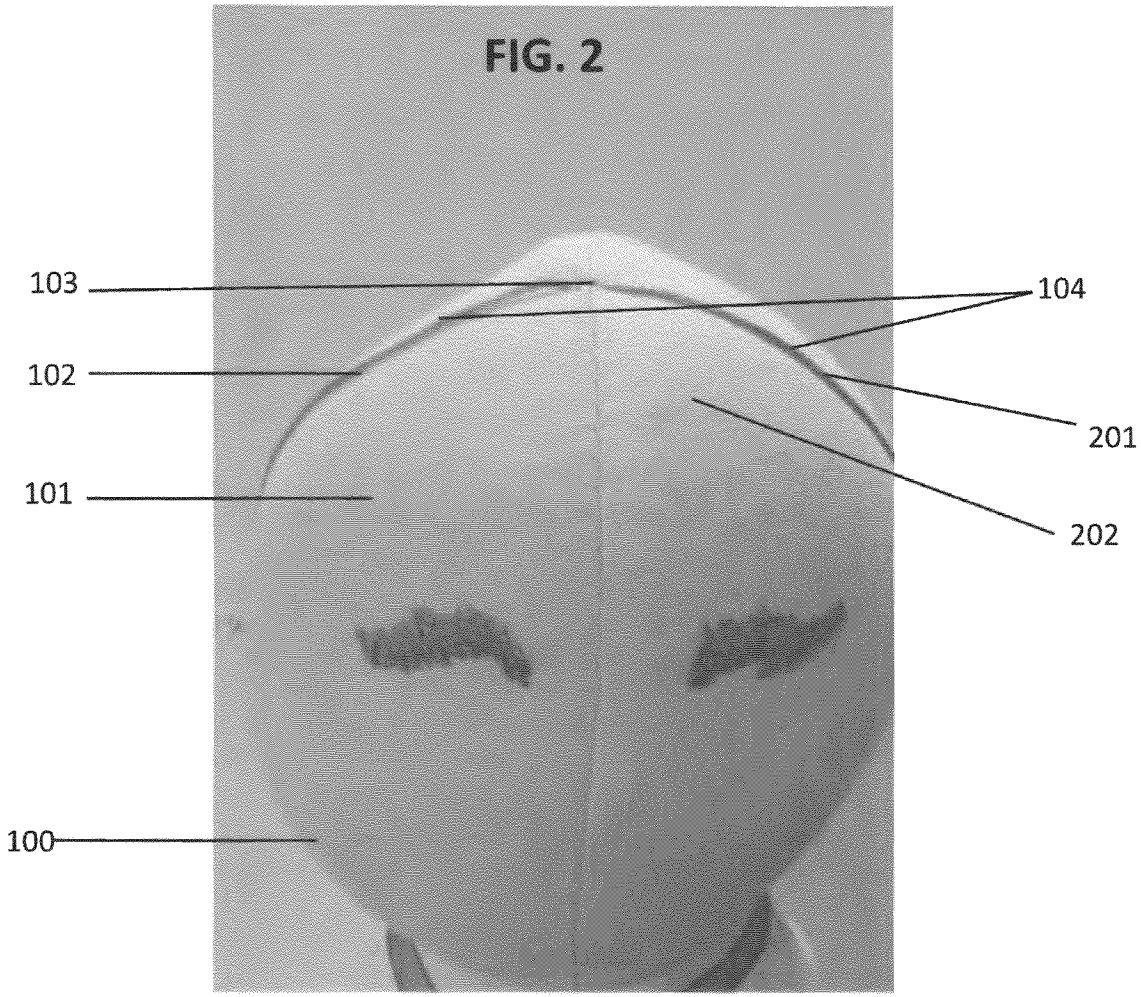
FIG. 2 comprises a front view as configured in accordance with various embodiments of the invention.
Figure 3:
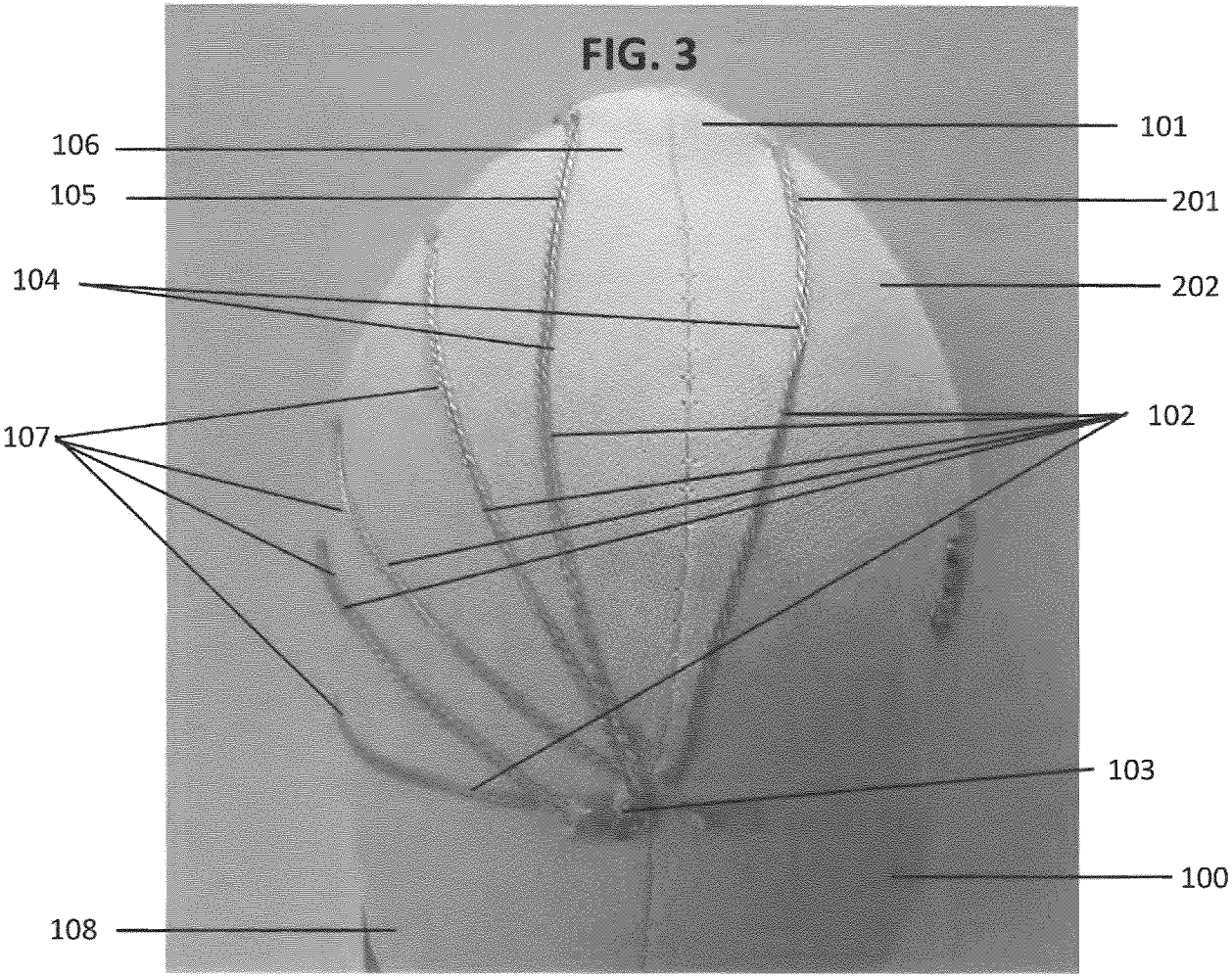
FIG. 3 comprises a side view as configured in accordance with various embodiments of the invention.

These and other benefits may become clearer upon making a thorough review and study of the following detailed description. Referring now to the drawings, and in particular to FIGS. 1-3, an illustrative process that is compatible with many of these teachings will now be presented with these figures depicting one approach that comports with these teachings. In this example, a doll head 100 includes a scalp 101 that is traversed by the aforementioned non-mesh hair securement strips 102. (As used herein, this reference to "non-mesh" will be understood to refer to strips that are not configured in integral combination with one another in the form of a net that features a regularly-spaced lattice-like framework of cross members that form, in turn, a corresponding plurality of (typically similarly-sized) holes.)

The non-mesh hair securement strips 102 have at least one minor (i.e., "small") portion 103 and at least one majority portion 104 that are attached to the scalp 101. In this illustrative example the minor portion 103 of the non-mesh hair securement strip 102 is attached to the scalp 101 of the doll head 100 by a sewn tack. This arrangement restricts the movement of the minor portion 103 to the area of attachment.

The majority portion 104 of the non-mesh hair securement strip 102, being unattached to the doll's surface, is less constricted than the minor portions 103 with respect to being able to move with respect to the scalp 101 of the doll head 100. Accordingly, the majority portion 104 of the non-mesh hair securement strip 102 can be moved away from the scalp 101 of the doll head 100 (for example, by placing a user's finger, a handheld tool, or a hair component itself between the majority portion 104 and the scalp 101 of the doll head 100) to facilitate attaching hair components as described below.

These non-mesh hair securement strips 102 can be laid in a particular manner/pattern with respect to the scalp 101 of the doll head 100 if desired. In this illustrative example a single length of embroidery floss is attached at various locations on the scalp 101 of the doll head 100 to form the various strips 102.

These teachings will accommodate using as many, or as few, such non-mesh hair securement strips 102 as may suit the needs and/or leverage the opportunities of a given application setting. In this particular illustrative example there are six non-mesh hair securement strips 102. It will be understood, however, that there can be fewer such strips (such as two or three) or more such strips (such as seven or eight) and that no particular limitations are intended by way of the specificity of this example.

In this particular non-limiting example as shown in FIG. 3 a first non-mesh hair securement strip 201 is attached at the brow 202 of the scalp 101 area of the doll head 100. A second non-mesh hair securement strip 105 is attached near the crown 106 of the scalp 101 area of the doll head 100. And four additional non-mesh hair securement strips 107 are dispersed on the back of the doll head between the crown 106 to just above the neck area 108 thereof. In this example each of the non-mesh hair securement strips 102 is secured to the head 100 on opposing sides of the scalp 101 of the doll head 100 and at another point located approximately midway across the scalp 101 of the doll head 100. So configured, each of the non-mesh hair securement strips 102 provides two majority portions 104 to receive hair components as described below.

In the example provided above the non-mesh hair securement strips 102 are comprised of a length of embroidery floss. These teachings will accommodate a wide variety of alternatives in these regards, however, including various elastic and non-elastic materials. Examples include but are not limited to a variety of threads and yarn, rickrack, cordage, rope, cable, string, fiber, and so forth. If desired, a variety of such materials can be used in conjunction with a single head 100 to accommodate, for example, different intended hair components or other application setting variations.

Figure 4:
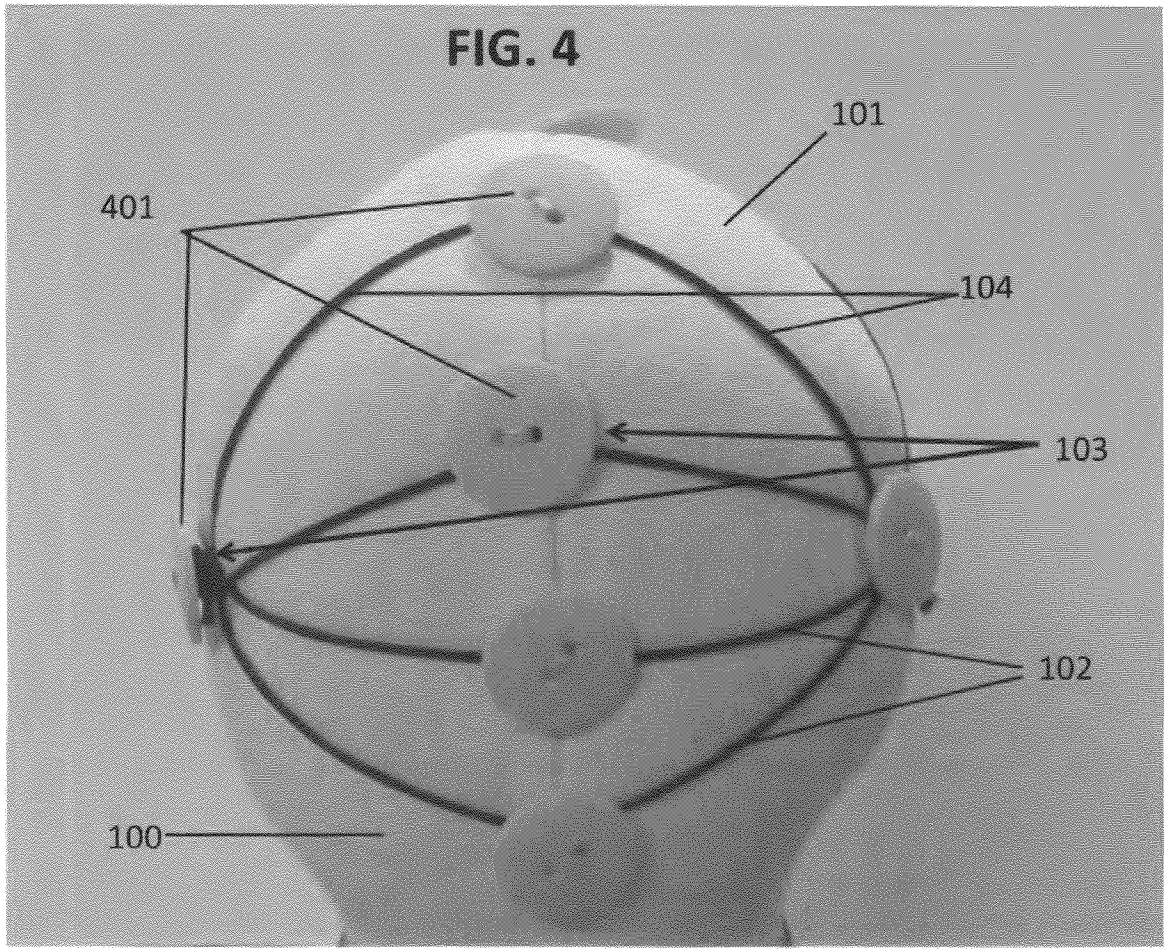
FIG. 4 comprises a rear view as configured in accordance with various embodiments of the invention.

As noted above, the non-mesh hair securement strips 102 can be attached to the head 100 by sewing the strips 102 into or onto the material that comprises the scalp 101 of the head 100. These teachings are highly flexible in these regards, however, and will accommodate a wide variety of alternative approaches. For example, and depending upon the particular circumstances of a given application setting, the non-mesh hair securement strips 102 can be attached to the head 100 by associating the strips 102 with buttons 401 that are themselves sewn, glued, or otherwise secured to the head 100 as shown in FIG. 4. For example, each strip 102 can encircle (as many times as desired) such a button 401 to thereby locally restrain the corresponding strip 102 to form the aforementioned minor portion 103.

Figure 5:
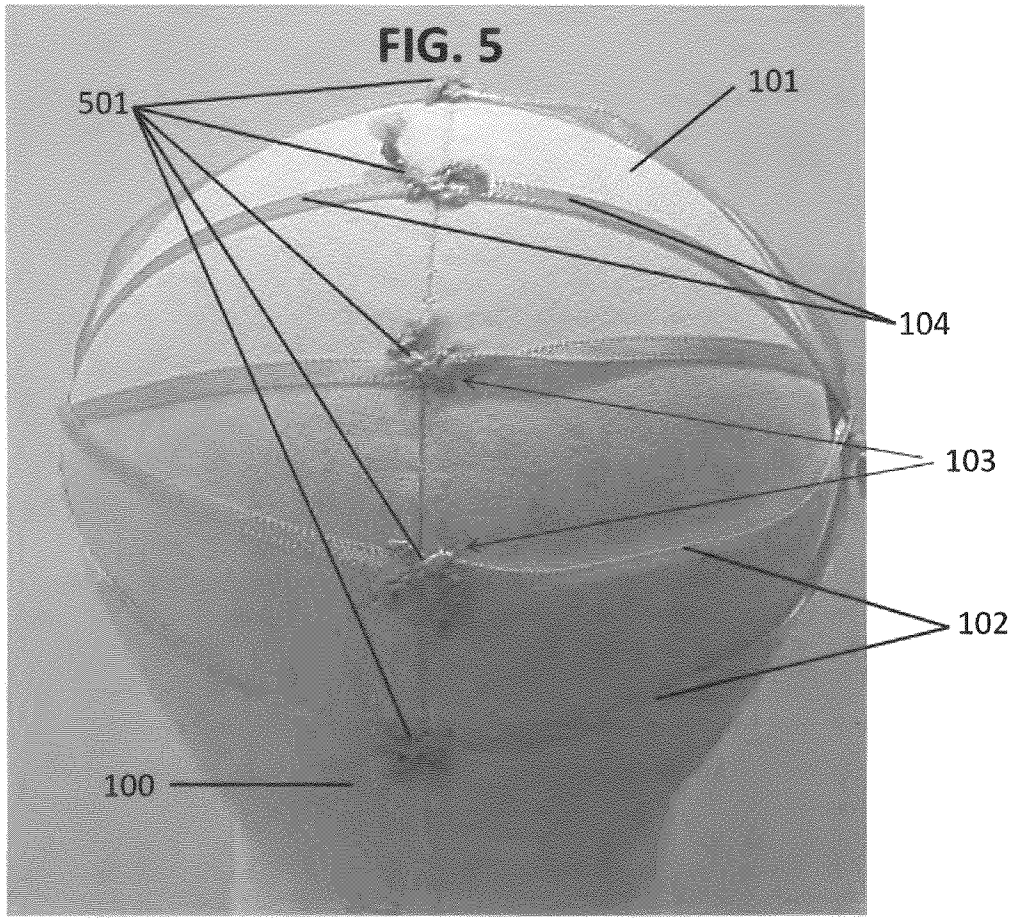
FIG. 5 comprises a rear view as configured in accordance with various embodiments of the invention.

As another example, and referring now to FIG. 5, a guide 501 comprising an "X" or other pattern of choice can be formed using thread (or the like) that is sewn or otherwise attached to the scalp 101 of the doll head 100 at the desired locations for the minor portions 103. In this case the non-mesh hair securement strips 102 can each be directed through (or under) the guide 501 to thereby so form the minor portion 103.

Figure 6:
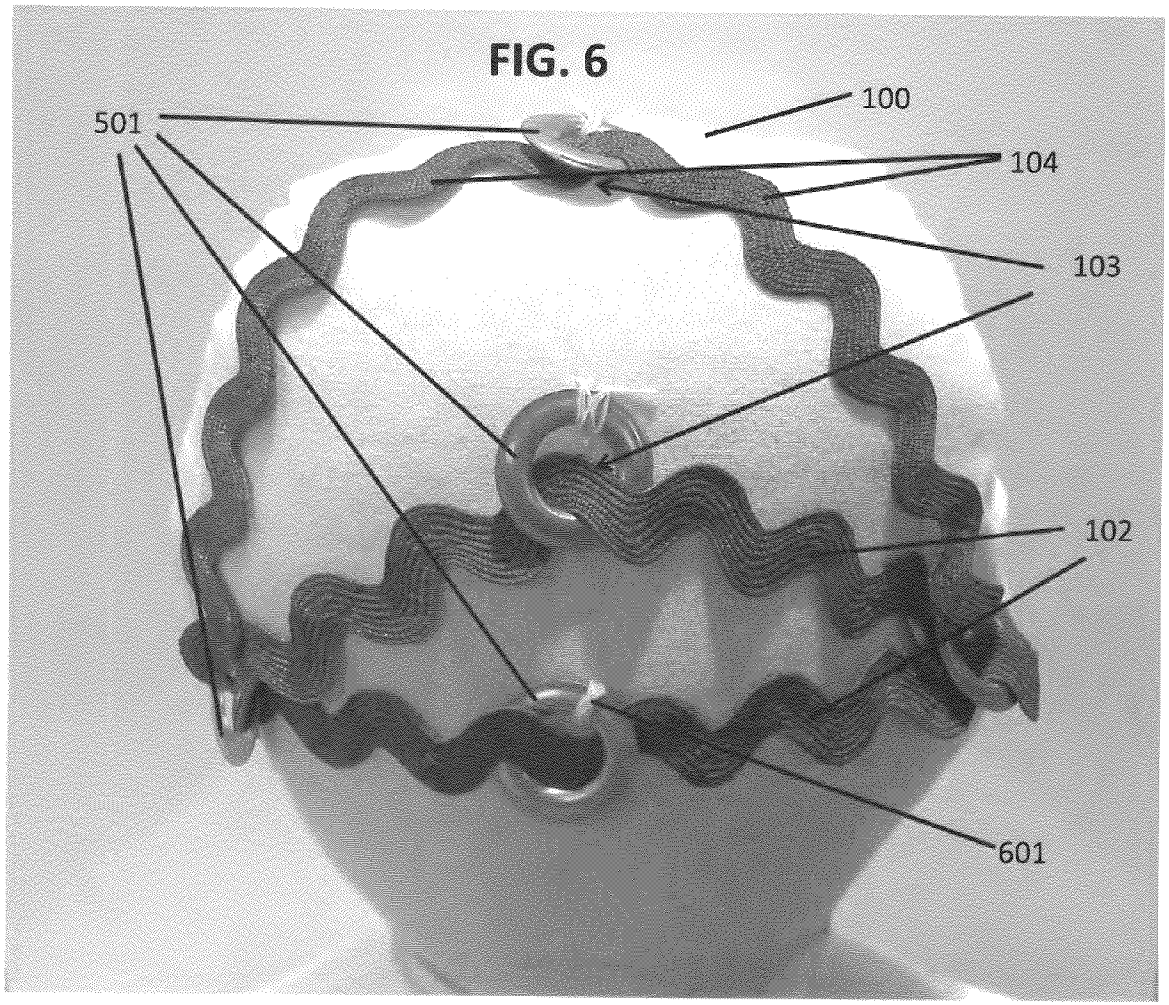
FIG. 6 comprises a rear view as configured in accordance with various embodiments of the invention.

FIG. 6 offers yet another example in these regards. In this example the guide 501 comprises a ring that is itself secured to the head 100 by thread 601. The relative size of the ring can vary as desired to accommodate, for example, the width of the non-mesh hair securement strip 102, an amount of play that may be desired, and so forth. So configured the non-mesh hair securement strips 102 can pass through the ring to form the above-described pattern (or other pattern of choice). In such a case, although the strip 102 is not secured to the head 100 at the location of the guide 501 the movement of the strip 102 is nevertheless constrained and hence the aforementioned minor portion 103 can again be formed. In particular, the strip's movement away from the scalp 101 of the doll head 100 is sufficiently constrained so as to serve as described herein.

Figure 7:
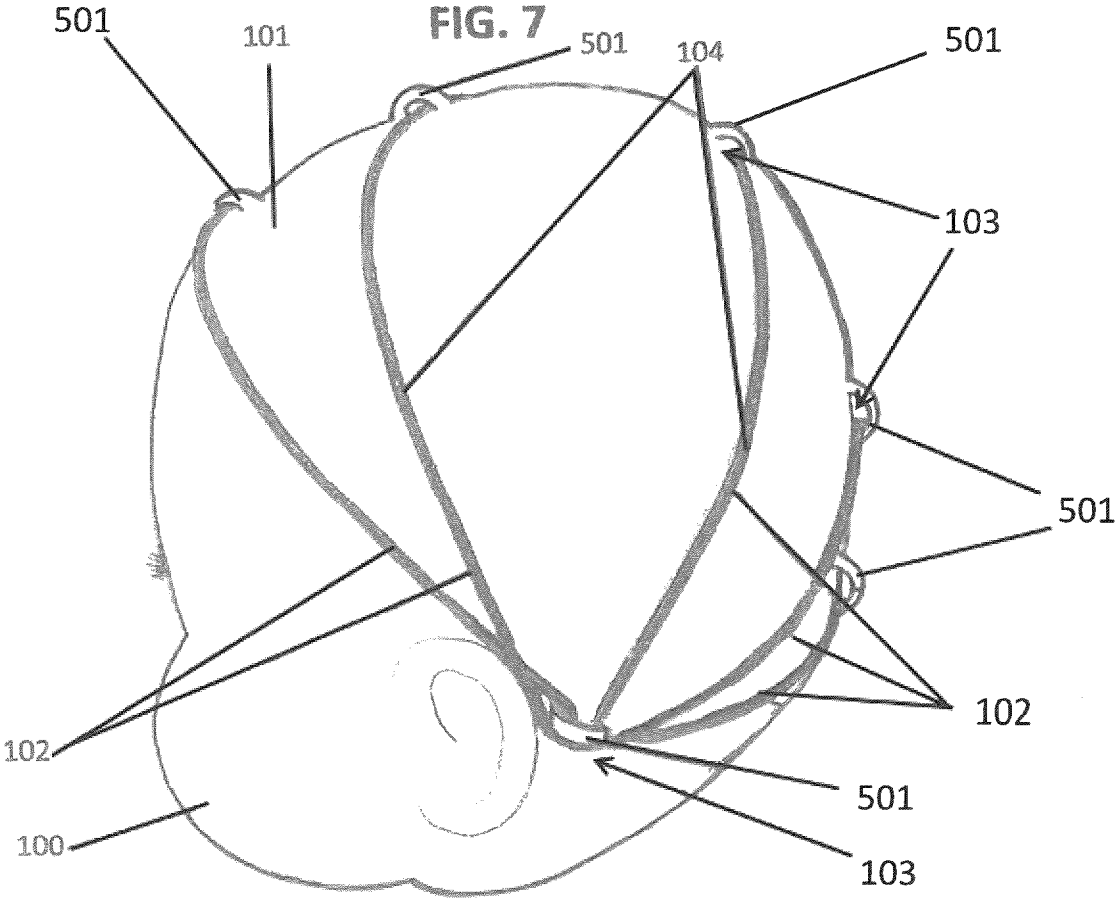
FIG. 7 comprises a side perspective view as configured in accordance with various embodiments of the invention.

And FIG. 7 offers yet another illustrative example in these regards. In this example the guide 501 comprises a loop that again serves to receive and accommodate one or more non-mesh hair securement strips 102. This approach will again serve to restrict the movement of the minor portions 103 to the area of attachment. And again, the majority portions 104 of the non-mesh hair securement strip 102 are less constricted than the minor portions 103 with respect to the opportunity to move away from the scalp 101 of the doll head 100. And also again, the majority portions 104 of the non-mesh hair securement strip can be moved away from the scalp 101 of the doll head 100 to facilitate placing and attaching desired hair components.

In this particular illustrative example the doll's head 100 comprises a plastic material. In this case the guides 501 can be secured to the scalp 101 of the doll head 100 using, for example, an adhesive of choice, sonic welding, a corresponding clip or bracket, or other mechanical attachment mechanism of choice. These teachings will also accommodate forming the guides 501 as an integral part of the scalp 101 of the doll head 100, for example, by co-molding the guides 501 with the head 100.

By one approach, and as illustrated, the non-mesh hair securement strip 102 comprises a single strip of elastic material that passes through all of the guides 501 in a sequential manner. The ends of this single strip 102 can be secured in place by, for example, adhering both ends of the strip 102 to the doll head 100 using an adhesive, by affixing the two ends of the single strip 102 to one another (for example, via a corresponding knot), by tying the respective ends of the strip 102 to corresponding anchor points, by use of one or more clips, or by any other useful approach in these regards.

It will be understood that the foregoing examples are intended to serve an illustrative purpose but are not intended to comprise an exhaustive description in these regards. In fact, these teachings will accommodate numerous other ways of connecting and/or associating such strips 102 to a doll's head 100. As one further example in these regards, these teachings will support using a post or other raised body on the doll's head to serve as an anchor point (somewhat akin to a fence post) for the strip 102.

Figure 8:
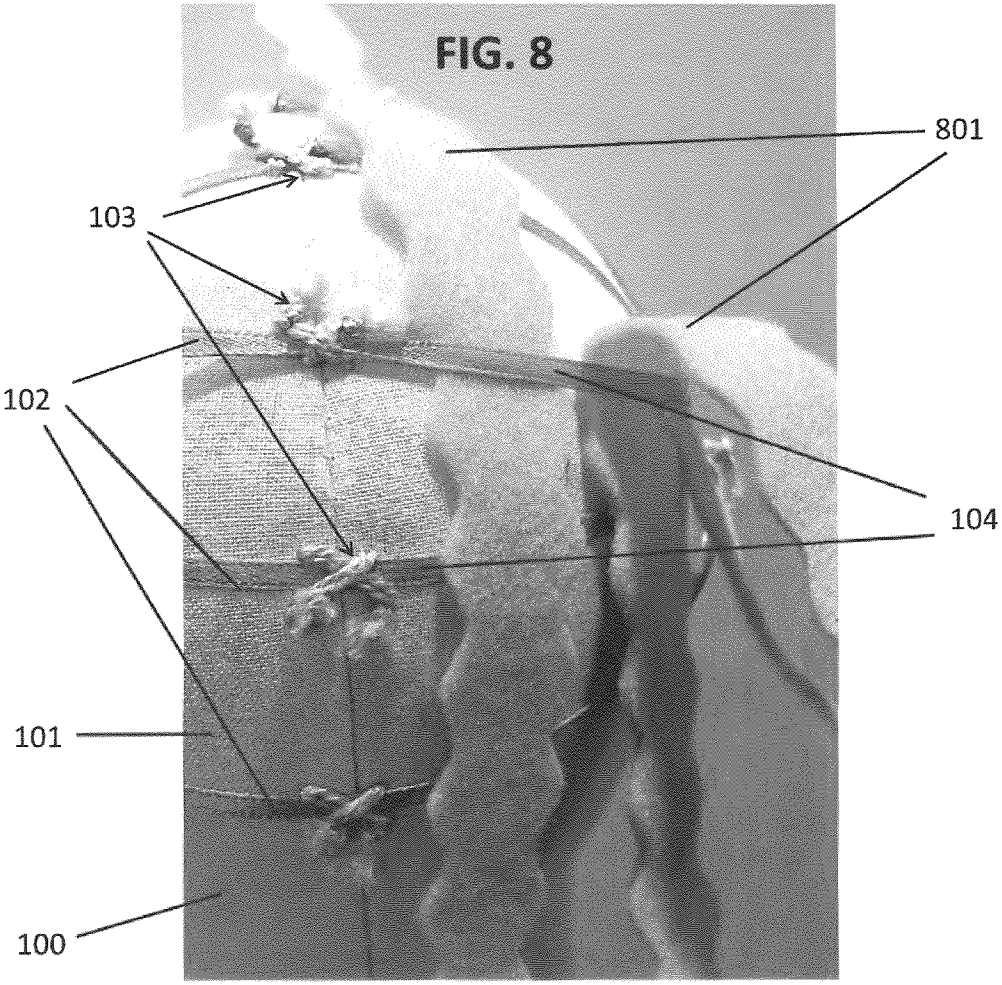
FIG. 8 comprises a rear detail view configured in conformance with various embodiments of the invention.
Figure 9:
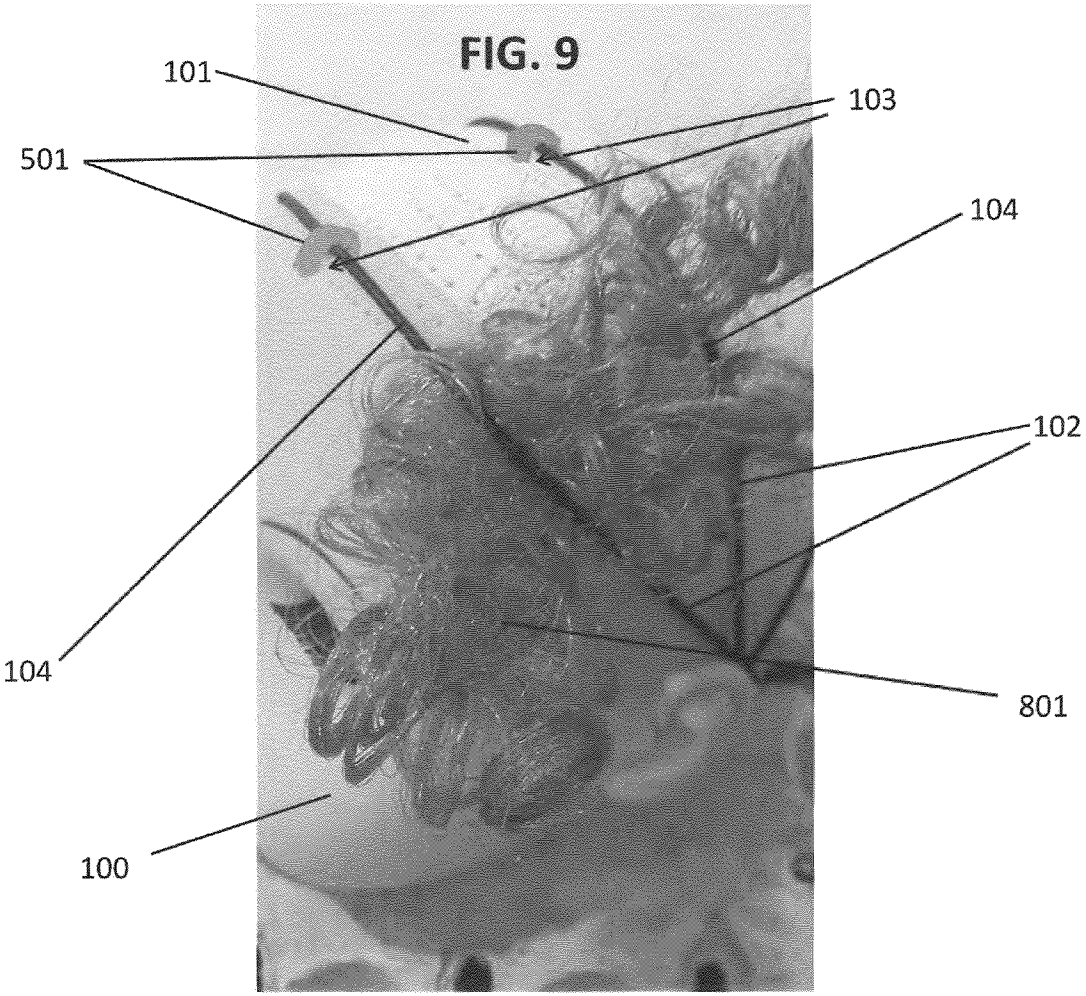
FIG. 9 comprises a top perspective view configured in accordance with various embodiments of the invention.
Figure 10:
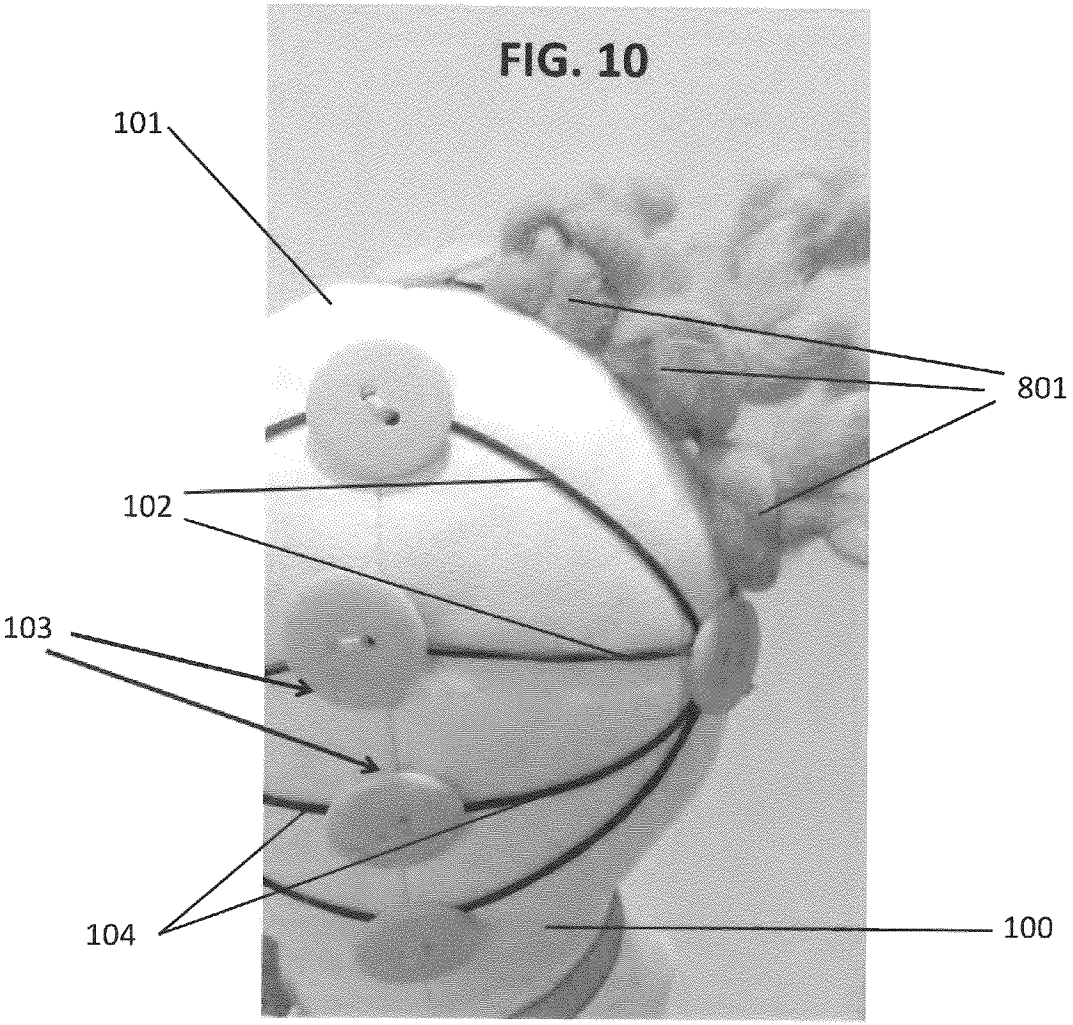
FIG. 10 comprises a rear perspective view configured in accordance with various embodiments of the invention.

As noted above, these non-mesh hair securement strips 102 will readily accommodate a wide variety of hair components. FIGS. 8-10 offer a variety of illustrative examples in these regards.

Figure 8A:
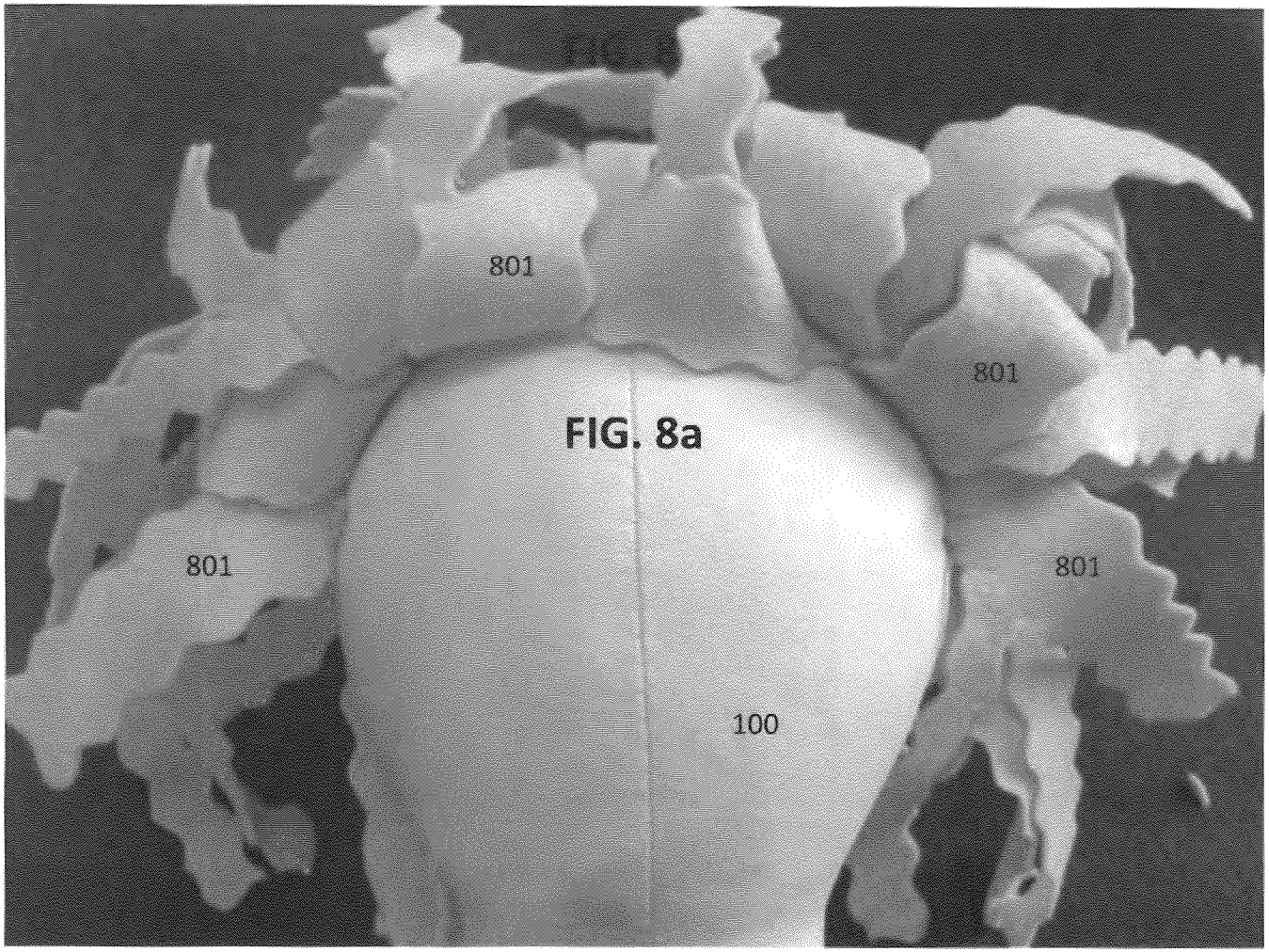
FIG. 8*a* comprises a front view configured in accordance with various embodiments of the invention.

As shown in FIGS. 8 and 8*a*, for example, hair-component strands 801 (in this case comprised of strips of felt or other cloth or cloth like material of choice) can be disposed between such a non-mesh hair securement strip 102 and the scalp 101 and the strand 801 then draped over or otherwise folded about the non-mesh hair securement strip 102 to form part or all of the doll's hair.

Figure 9A:
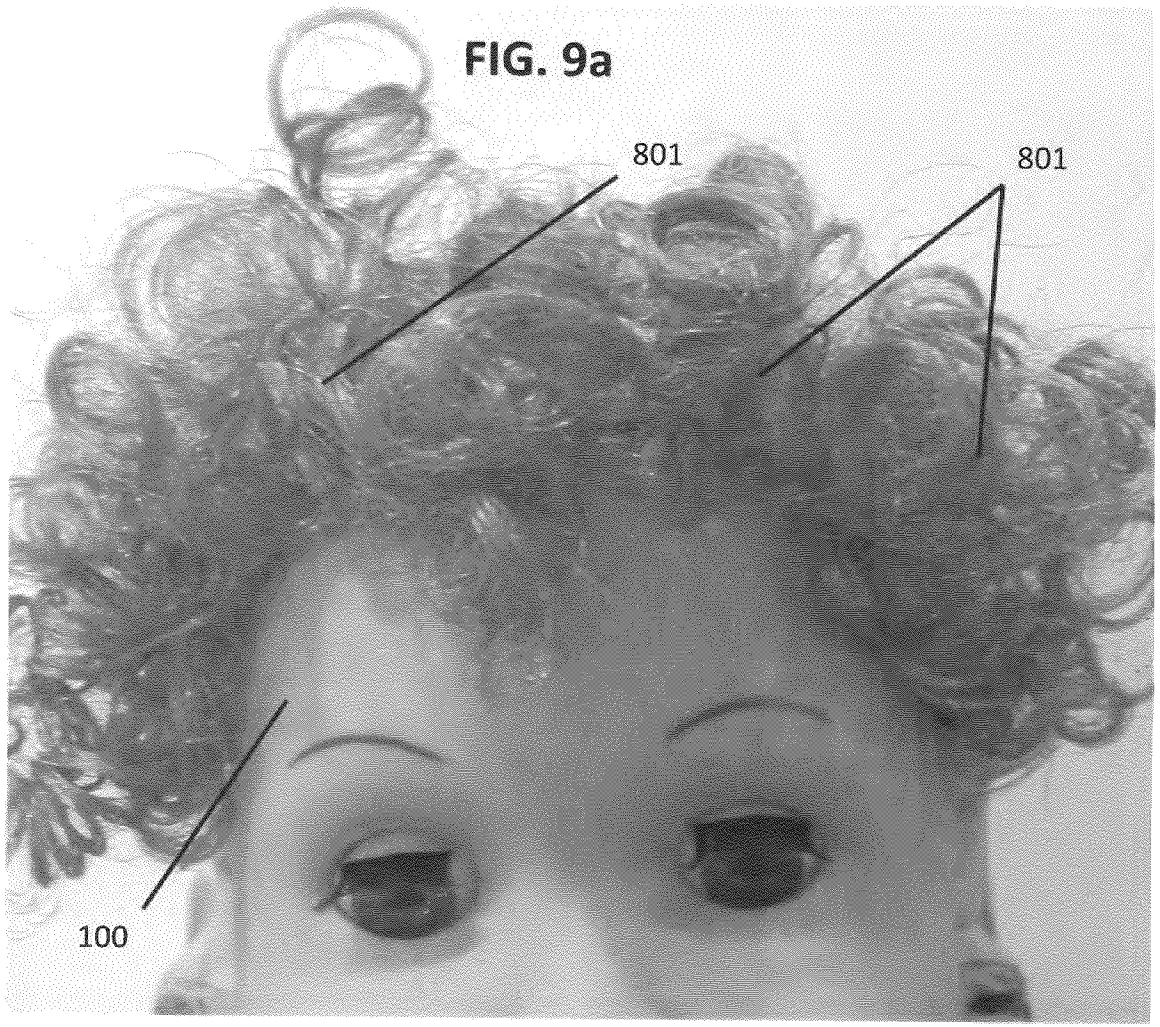
FIG. 9*a* comprises a front view configured in accordance with various embodiments of the invention.

As shown in FIGS. 9 and 9*a*, and as another example, hair-component strands 801 (in this case comprised of coiled lengths of real or artificial hair) are simply tucked between the major portion 104 of a particular one or more non-mesh hair securement strip 102 and the scalp 101 to thereby hold the hair-component strand 801 in place.

Figure 10A:
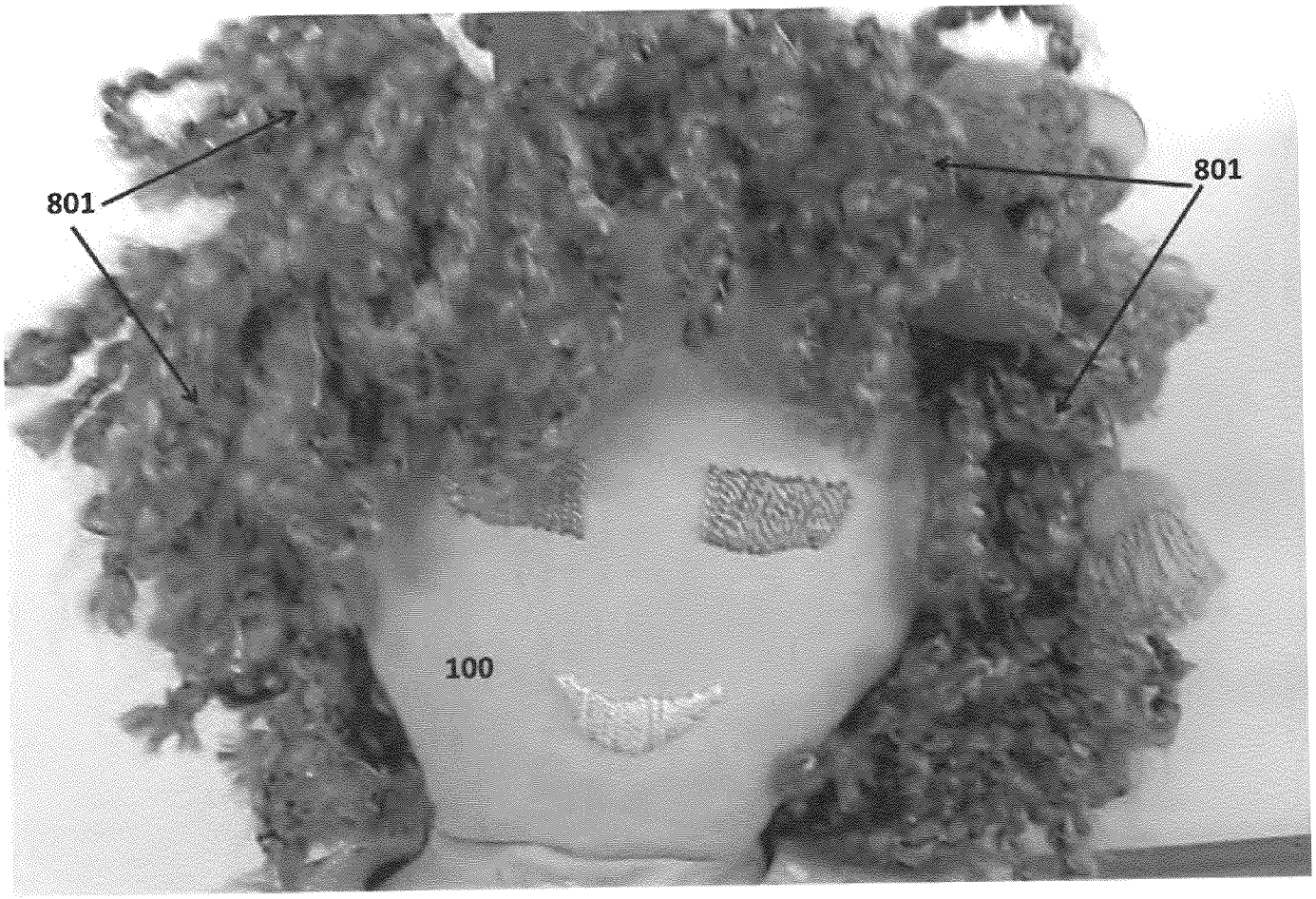
FIG. 10*a* comprises a front view configured in accordance with various embodiments of the invention.

FIGS. 10 and 10*a* provides an example where lengths of yarn serve as the hair-component strands 801. In this example the yarn is tied to the non-mesh hair securement strips 102 using any knot of choice.

Figure 11:
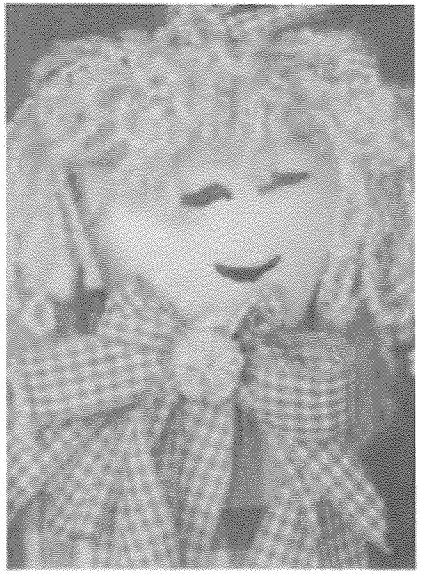
FIG. 11 comprises a plurality of front views configured in accordance with various embodiments of the invention.
Figure 11:
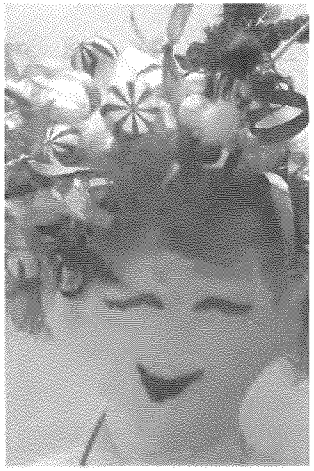
Figure 11:
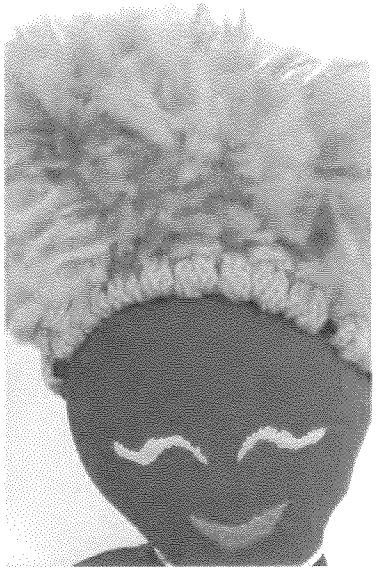
Figure 11:
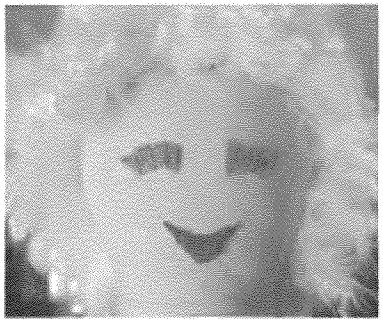
Figure 11:
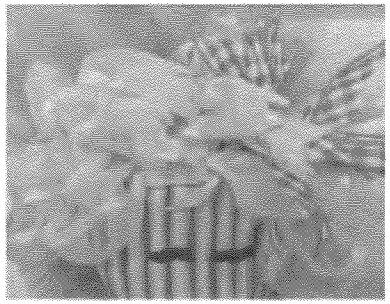
Figure 11:
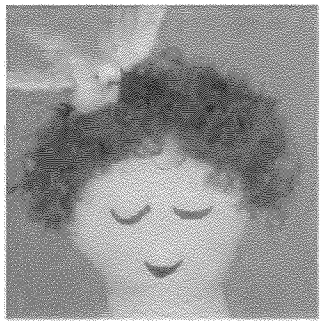

As noted above, these teachings will accommodate a wide variety of both traditional and non-traditional hair components with only a few examples in these regards being shown in FIG. 11. Accordingly, both manufacturers and the consumer are offered a nearly unfettered opportunity to use their imaginations as regards the specific hair components employed and their disposition on a doll configured in accordance with these teachings. It will also be noted and appreciated that such hair components can be easily placed where desired and that these hair components can just as easily be removed and replaced as desired, or for other hair components to be substituted therefor at the discretion of the user.

These teachings offer the benefit of continuous opportunities for creativity and flexibility for both doll manufacturers and doll users. These opportunities include the ability to freely change (and re-change) the look and feel of the doll hair during the use and/or display of the doll to thereby, for example, complement clothing or costumes that are appropriate for the cultural, artistic, or play role of a particular doll. These teachings will readily accommodate hair components that are made from realistic and/or fanciful materials such as real or artificial hair, yarn, tulle, fleece, felt, cloth, ribbons, pipe cleaners, macrame cord, holiday picks, artificial fruit and flowers, or anything similar to these components known in the art. These teachings also provide manufacturers with considerable ease of production and the opportunity to offer a doll that can be easily and repeatedly customized by the user.

Figure 12:
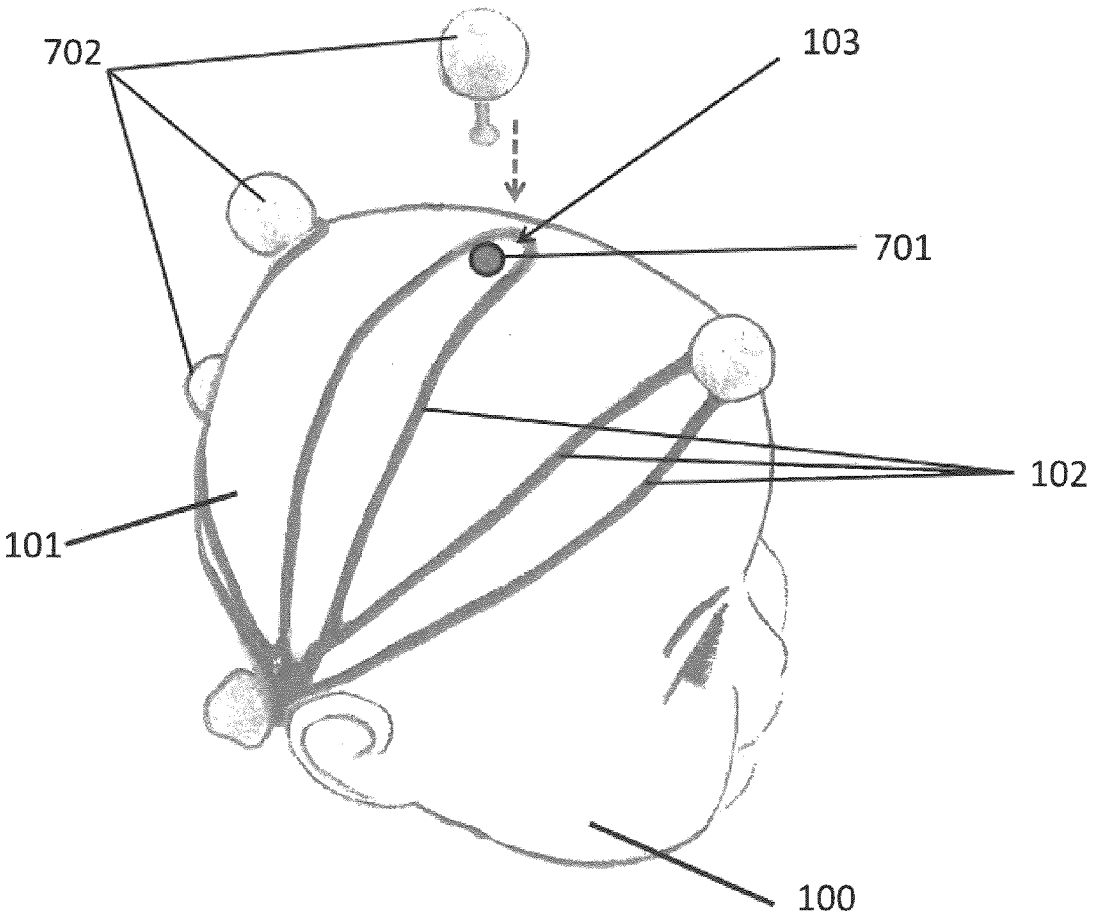
FIG. 12 comprises a top perspective view configured in accordance with various embodiments of the invention.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept. As but one simple example in these regards, and referring to FIG. 12, the manufacturer may offer a doll with holes 701 strategically placed in a doll head 100 made of plastic, for example, that may, or may not, be used at the time of manufacture, or at a later time, to receive a corresponding post or ball that pops into (and out of) that hole to which non-mesh hair securement strips are attached. As illustrated, holes 701 can be strategically placed in the scalp 101 of the doll head 100 to thereby effect a particular coverage scheme or pattern. The holes are of such a size so as to receive, by way of "popping" in (and out), posts, balls, or any other suitable protuberance 702 that extends outwardly above the surface of the scalp 101 so as to create an attachment point and minority portion 103 for non-mesh hair securement strips. By one approach, and as illustrated, the non-mesh hair securement strips 102 are comprised of rubber bands.

What is claimed is:

1. An apparatus comprising:

a doll body component having an exterior surface;

at least one non-mesh, hair-securement elongated strip disposed on the exterior surface and having at least two minor portions that are constrained with respect to movement away from the exterior surface and where a majority portion of the strip can be moved away from the exterior surface with less constraint than the two minor portions.

2. The apparatus of claim 1 wherein the doll body component comprises a head.

3. The apparatus of claim 2 wherein the exterior surface comprises a scalp.

4. The apparatus of claim 1 further comprising a plurality of the non-mesh, hair-securement elongated strips that each have at least two minor portions that are constrained with respect to movement away from the exterior surface and where a majority portion of each of the strips can be moved away from the exterior surface with less constraint than the two minor portions.

5. The apparatus of claim 4 wherein the plurality of non-mesh, hair-securement elongated strips consists of six of the non-mesh, hair-securement elongated strips.

6. The apparatus of claim 4 wherein:

one of the plurality of the non-mesh, hair-securement elongated strips comprises a brow strip;

one of the plurality of the non-mesh, hair-securement elongated strips comprises a crown strip.

7. The apparatus of claim 1 wherein the non-mesh, hair-securement elongated strip is attached to the exterior surface at the two minor portions.

8. The apparatus of claim 7 wherein the non-mesh, hair-securement elongated strip is attached to the exterior surface at three minor portions.

9. The apparatus of claim 1 wherein the non-mesh, hair-securement elongated strip couples to the exterior surface at at least one of the minor portions without attaching to the exterior surface at the at least one of the minor portions.

10. The apparatus of claim 9 wherein the exterior surface includes at least one guide through which the non-mesh, hair-securement elongated strip passes to thereby couple the non-mesh, hair-securement elongated strip to the exterior surface without attaching the non-mesh, hair-securement elongated strip to the exterior surface at the guide.

11. A method comprising:

providing a doll body component having an exterior surface and at least one non-mesh, hair-securement elongated strip disposed on the exterior surface and having at least two minor portions that are constrained with respect to movement away from the exterior surface and where a majority portion of the strip can be moved away from the exterior surface with less constraint than the two minor portions;

disposing between the exterior surface and at least a part of the majority portion of the strip a hair component as comprises a part of a hairpiece for the doll body component.

12. The method of claim 11 wherein the doll body component comprises a doll head and the exterior surface comprises a scalp.

13. The method of claim 11 further comprising:

securing the hair component to the non-mesh, hair-securement elongated strip.

14. The method of claim 13 wherein securing the hair component to the non-mesh, hair-securement elongated strip comprises tucking the hair component with respect to the non-mesh, hair-securement elongated strip.

* * * * *